US007182567B2

(12) United States Patent
Huotari et al.

(10) Patent No.: US 7,182,567 B2
(45) Date of Patent: Feb. 27, 2007

(54) METHOD AND DEVICE FOR ADDITIONAL PRESSING DURING A PAGE NIPPING EVENT

(75) Inventors: Lisakki Huotari, Helsinki (FI); Lauri Huotari, Espoo (FI); Jaakko Huotari, Helsinki (FI); Henri Huotari, Espoo (FI); Markku Siikamaki, Espoo (FI); Peter Archer, Helsinki (FI)

(73) Assignee: Maping KY (FI)

( * ) Notice: Subject to any disclaimer, the term of this patent is extended or adjusted under 35 U.S.C. 154(b) by 623 days.

(21) Appl. No.: 10/229,295

(22) Filed: Aug. 23, 2002

(65) Prior Publication Data

US 2004/0037672 A1 Feb. 26, 2004

(30) Foreign Application Priority Data

Feb. 23, 2000 (FI) ..... 20000424

(51) Int. Cl.
*B42C 11/04* (2006.01)

(52) U.S. Cl. ..... 412/5; 412/1; 412/4; 412/19; 412/22; 412/23; 412/29

(58) Field of Classification Search ..... 412/1, 412/3–5, 9, 17, 19, 22–24, 29, 901, 902, 412/6, 8

See application file for complete search history.

(56) References Cited

U.S. PATENT DOCUMENTS 2,644,965 A * 7/1953 Kitcat ..... 412/29
3,451,082 A * 6/1969 Sarring ..... 412/5
3,531,358 A * 9/1970 Hesselmann ..... 156/475
3,786,529 A * 1/1974 Bendror et al. ..... 412/1
3,825,963 A * 7/1974 Abildgaard et al. ..... 412/21
4,077,078 A * 3/1978 Snellman et al. ..... 412/4
4,263,687 A * 4/1981 Ferguson ..... 412/29
4,556,353 A * 12/1985 Ehlermann ..... 412/5
4,978,267 A * 12/1990 Kolkhorst ..... 412/21

(Continued)

FOREIGN PATENT DOCUMENTS

EP 0745491 A1 12/1996

(Continued)

OTHER PUBLICATIONS

Van Vlack, Lawrence, "Elements of Materials Science and Engineering", Nov. 1980, Addison-Wesley Publishing Company, Inc., Fourth Edition, p. 7.*

*Primary Examiner*—Monica Carter
*Assistant Examiner*—Eric A. Gates
(74) *Attorney, Agent, or Firm*—Skinner and Associates

(57) ABSTRACT

A method and device for additional pressing during a page nipping event in the adhesive binding of books or corresponding objects. One part of the cover (1) and the spine of the book are folded around the block (2) formed by the book's pages and glued on the spine of the block. The other part of the cover is folded into shape by means of a moveable jaw (8). The aforementioned folding of the cover (1) is accomplished by the aid of an additional compactor (9) acting by way of a stiffening brace (10) supporting the block (2). Alternatively, the process may be aided directly by the flexible support (7) by, for example, making a fold in the support (7) which causes it to function as a spring.

7 Claims, 3 Drawing Sheets

Figures 1A, 1B, 1C:
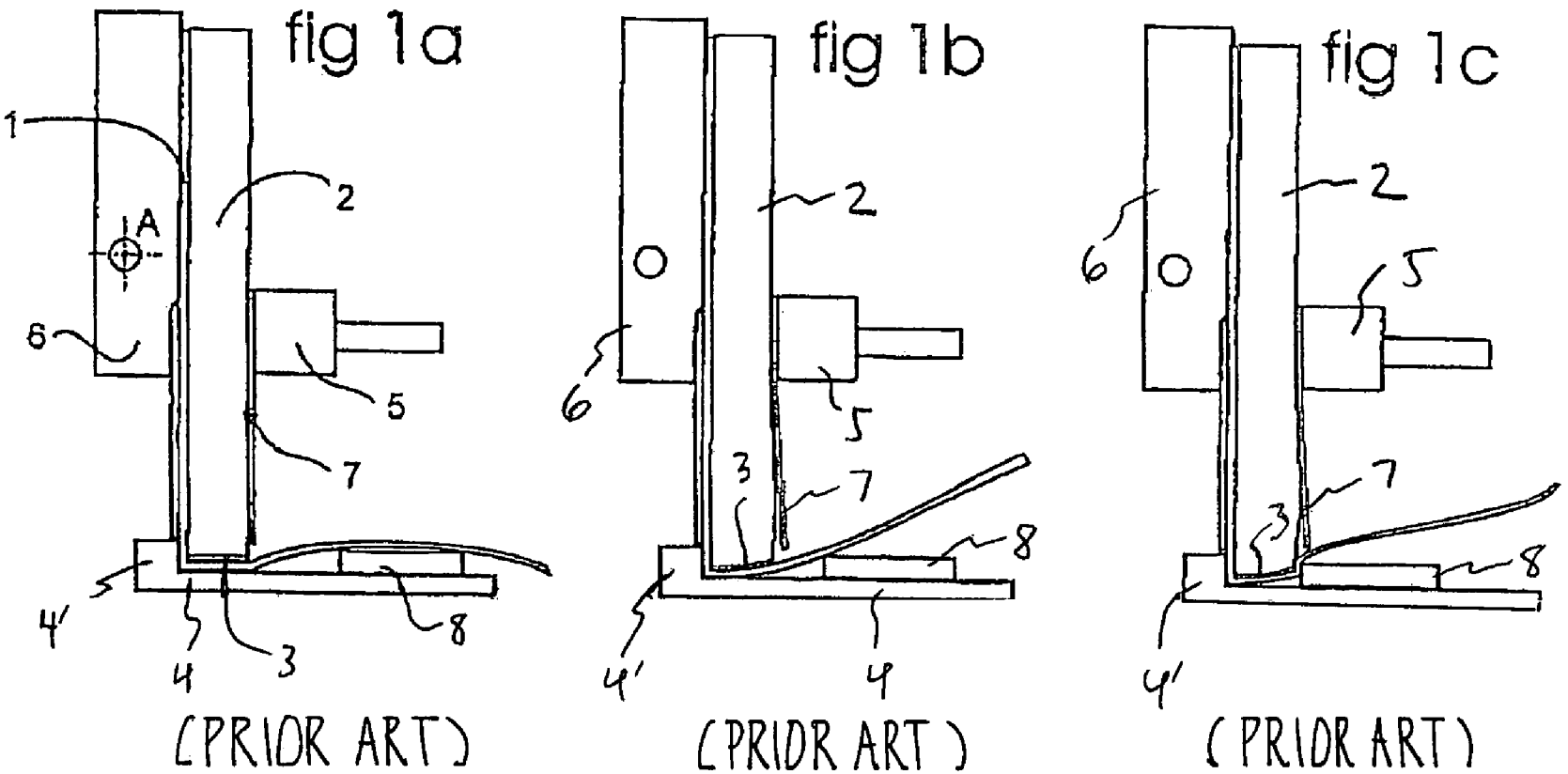
(PRIOR ART) fig 1b
(PRIOR ART) fig 1c

U.S. PATENT DOCUMENTS 5,314,283 A * 5/1994 Zoltner ..... 412/34
5,413,447 A * 5/1995 Rathert ..... 412/19
5,871,323 A * 2/1999 Clark ..... 412/4
6,155,763 A * 12/2000 Parker et al. ..... 412/6
6,428,260 B1 * 8/2002 Parker ..... 412/6
6,709,727 B1 * 3/2004 Parker ..... 428/40.1

FOREIGN PATENT DOCUMENTS

GB 2149351 A 6/1985
JP 10-016437 1/1998

* cited by examiner 1
2
3
4
4'
5
6
7
8
A 2
3
4
4'
5
6
7
8

2
3
4'
5
6
7
8
(PRIOR ART)

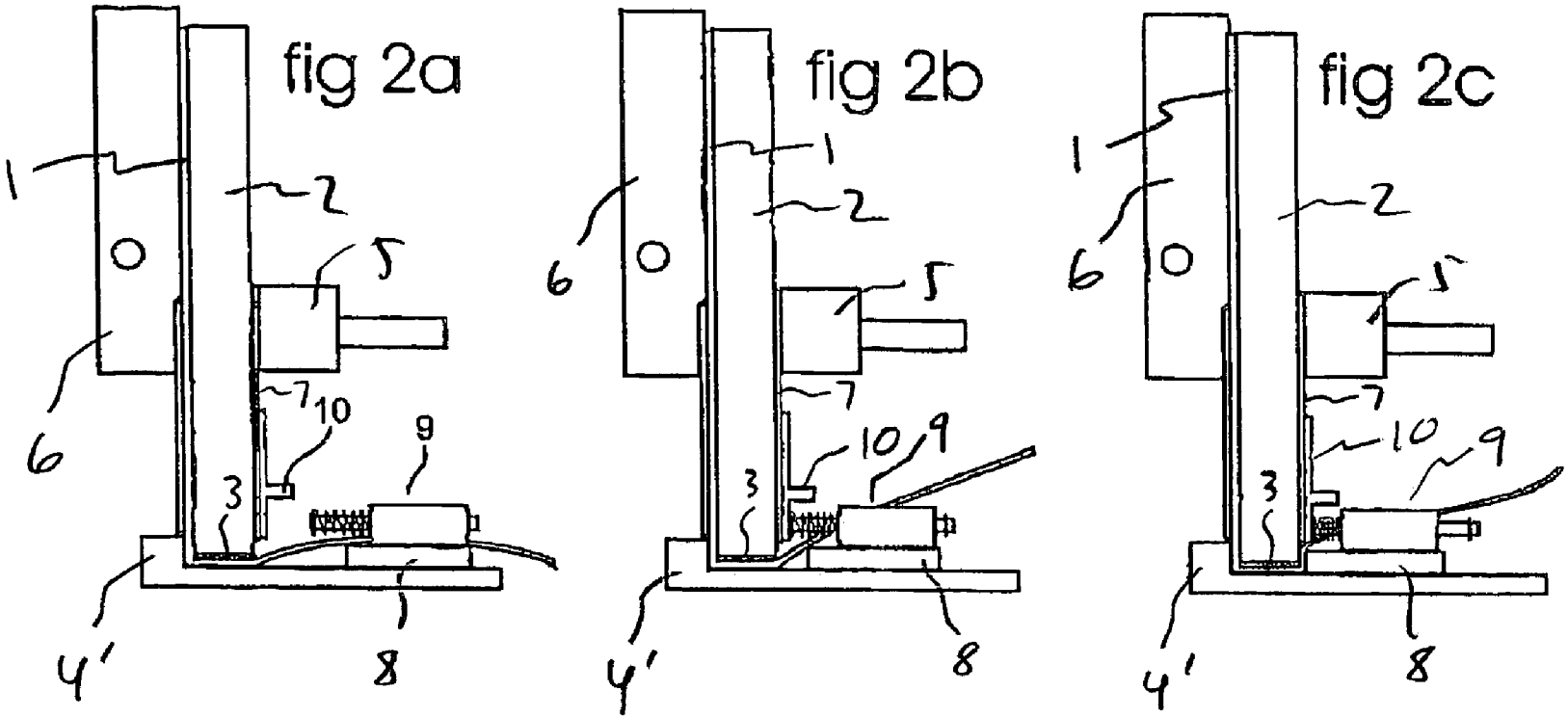
fig 2a
fig 2b
fig 2c
1
2
3
4'
5
6
7
8
9
10
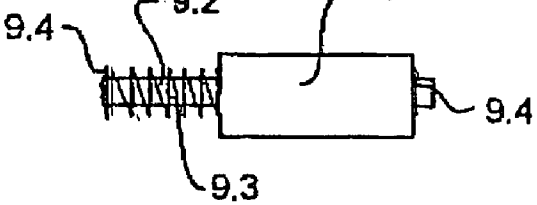
fig 2d
9.1
9.2
9.3
9.4

1
2
3
4
4'
5
6
7
7.1
A

METHOD AND DEVICE FOR ADDITIONAL PRESSING DURING A PAGE NIPPING EVENT

BACKGROUND

The present invention relates to a method and device for additional pressing during a page nipping event in the adhesive binding of books.

The structure currently in common use for page nipping is described in more detail in the following with reference to the accompanying drawings, and in particular to FIGS. 1*a*, 1*b* and 1*c*, which portray the normal course of events as is commonly in use.

The cover 1 may be of any material whatsoever suited for its purpose as the cover material of a soft-covered book. Typically the cover is either paper, board, plastic or a combination of these materials.

The block 2 consists of the book's pages. The pages can typically be of paper, board, plastic or corresponding material. The purpose is for the cover material to be wrapped tightly around the block formed by the pages of the book and then to be attached, for example, by adhesive to the spine of block 2.

Any agent whatsoever, suitable for fastening cover 1 to block 2, may be used as the adhesive material 3. Typically, hot-setting adhesive or cold-dispersion adhesive is used.

Base 4 supports the spine of the book. Built into the base, or attached to it, is a stationary jaw 4', against which the book, which here refers to the combination of block and cover and the edge of the cover on the compression plate side, are pressed as the movable jaw of the base closes.

Pressing shaft 5 is used to press block 2 and cover 1 tightly against the compression plate 6. Pressing shaft 5 can be anchored for example to compression plate 6, so that it is fastened to the compression plate outside of the book and on both sides of it.

Compression plate 6 is a swivel plate that can be turned around axis A. In FIG. 1*a*, the swivel plate is in its lower position. The plate can be turned anti clockwise, causing the cover and the block to be released from the base. If it is assumed that no adhesive has yet been applied between the cover and the block, cover 1 will be separated from block 2 during the aforementioned turning movement. The cover being thus removed from the block, adhesive 3 can be applied to the spine of the block. Once the adhesive is applied, the swivel plate is turned back to the position shown in FIG. 1*a*.

Flexible guard 7 is fastened to pressing shaft 5 or its connection by taping, gluing, screwing, soldering, welding, riveting, pinching or by other commonly known method. The purpose of flexible guard 7 is to support the book during the application of adhesive.

Flexible guard 7 is typically spring steel band or a corresponding material that may be bent and will return after bending to its original or almost original position A flexible guard is also attached to the compression plate, as a result of which the bending of the book in the area between the pressing shaft and the cover is possible. The bending of the book is also known as fanning and is used to enhance the spreading of adhesive onto the sides of the pages to be bound.

The movable jaw 8 is located between cover 1 and base 4. It opens for at least the width of the book. The movable jaw is used to fold the cover and press it against the block. Movable jaw 8 is kept closed until a sufficiently strong adhesive joint has been established.

At the present time, page nipping is typically executed in the manner presented in FIGS. 1*a*, 1*b* and 1*c*. Initially, as shown in FIG. 1*a*, cover 1 and block 2 are pressed between pressing shaft 5 and compression plate 6. Between the cover and the paper block is some agglutination agent in a "free" state, meaning that adhesive 3 has not yet solidified. The compression plate is supported in such a way that the cover is in contact with base 4 at the point where it is attached to the paper block.

When movable jaw 8 has closed sufficiently, as shown in FIG. 1*b*, cover 1 exerts an upward force on the book. When the force is sufficient, some or all of the pages in the block buckle and the cover lifts off from the base where it is attached to the book. When movable jaw 8 has closed, as in FIG. 1*c*, the spine of the book is pressed between it and the stationary jaw of the base. When the adhesive joint has become sufficiently solid, movable jaw 8 is moved back to the open position.

The disadvantage is that the spine of the book is easily left crooked after the adhesive joint has solidified. This is especially true of some relatively thick board materials that are used for book covers. As a result of this, the appearance of the book is impaired. Crookedness in this context means deviations from a 90 degree angle in the spine of a book and/or the curvature of the spine.

SUMMARY OF THE INVENTION

The current invention is intended to create a method and mechanism which will eliminate the above-mentioned defects. This is achieved in the manner set out in the Claims.

In the following, the invention is described in more detail with reference to the accompanying drawings, in which certain general principles of certain embodiments of the invention are portrayed, without being limited to them in any way. It is self evident, that many technical solutions in the presented embodiments can be replaced by other technical solutions without deviating from the inventon's basic principles and spirit.

Thus, as was explained above

FIGS. 1*a*–1*c* present the state-of-the-art procedure;

FIGS. 2*a*–2*c* present, in a way corresponding to FIGS. 1*a*–1*c*, the equipping of the book with a cover according to the invention;

FIG. 2*d* presents a detail from a device in FIGS. 2*a*–2*c*; and

Figures 3A, 3B, 3C:
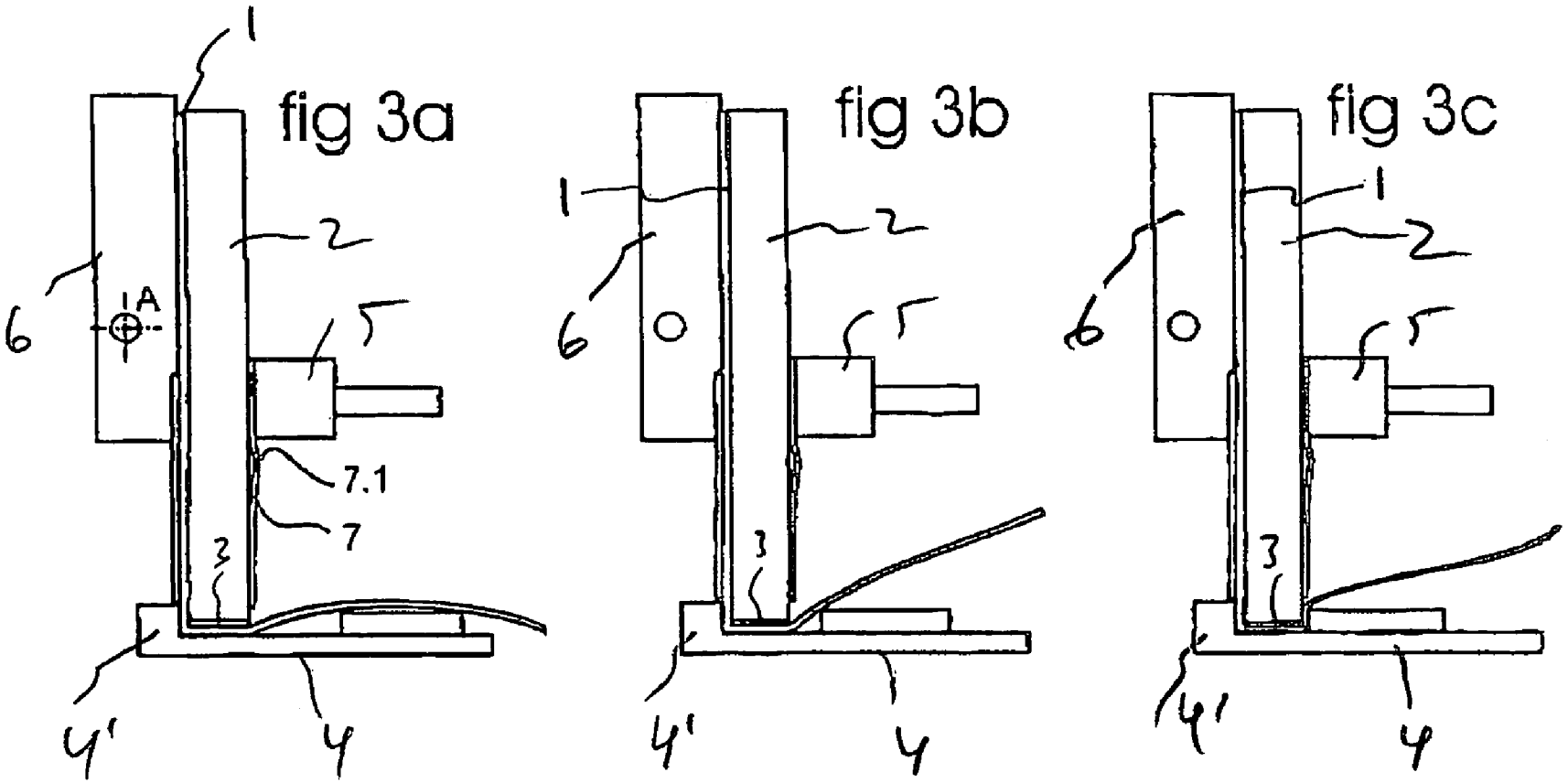

FIGS. 3*a* B 3*c* present another embodiment of a device according to the invention.

DETAILED DESCRIPTION

Thus, according to the first embodiment of the invention, the additional compactors 9 are attached to both ends of the movable jaw 8, generally described above, outside the cover and the block. The stiffening brace 10, which can be of the presented type but can also be of any other rigid material whatsoever, is attached to flexible guard 7.

Alternatively, additional compactors 9 are attached to the device's frame so that they are not in connection with movable jaw 8. The functioning of additional compactors 9 can thus either be linked to the operation of movable jaw 8 or the functioning can be totally independent of movable jaw 8 and self-sufficient.

The structure of the mechanism of an additional compactor 9 can be, for example, such as in FIG. 2*d*.

The body part 9.1 is attached to the movable jaw or its connection by taping, gluing, screwing, soldering, welding, riveting, pinching or by other commonly known method. Body part 9.1 can also be manufactured as an integral part of movable jaw 8. The body part can be manufactured, for example, from metal, metal alloy, plastic or any other material whatsoever suitable for the purpose. The body part as in FIG. 2*d* is pierced by a tubular hole through its length which functions as a guiding surface for shaft 9.2. Shaft 9.2 functions as a piston and the tubular hole in the body part as a cylinder surface. The movements of the shaft are restricted by means of the shaft bars 9.4 and the spring 9.3. The shaft can be manufactured, for example, from metal, metal alloy, plastic or any other material whatsoever suitable for the purpose. It is clear that, if it is so desired, several axles 9.2 can be fitted and thus their support effect can be expanded.

Although spring 9.3 is placed around the shaft in the exemplary figure, it can also be placed inside the shaft, provided the shaft has a suitable hole for its placement. There can also be several springs, in which case they can be placed around the shaft in such a way that they are fixed to the shaft in at least one point. The spring function can also be implemented by, for example, a leaf spring, a rubber spring, cup springs or by some other commonly known method. The spring element can be placed above or below movable jaw 8, or in any location between these extremes whatsoever, even in the centre, with respect to movable jaw 8.

The shaft bars 9.4 determine the outer limits of the movements of the shaft. At the same time, the positions of shaft bars 9.4 determine the amount of resting load applied to spring 9.3. A shaft bar may be substituted by any commonly known method or combination of methods whatsoever restricting the shafts longitudinal movement.

Stiffening brace 10 is attached to the pressing shaft 5 or its connection by taping, gluing, screwing, soldering, welding, riveting, pinching or by other commonly known method. The stiffening brace is attached sufficiently far from the pressing shaft 5 so that the flexible guard can still be bent. Stiffening brace 10 can be formed of one or more pieces according to whatever is most suitable in each case.

Stiffening brace 10 can also, in an alternative embodiment, be attached to shafts 9.2, in which case the movement of the shafts causes stiffening brace 10 to move with them and be pressed against paper block 2, thus resulting in a press.

Stiffening brace 10 extends at least from the shaft of one additional compactor to the shaft of another additional compactor. A hinge attached to the stiffening brace or its connection could be alternatively be envisaged to substitute the flexible guard. The flexible guard can also be formed, for example, by bevelling in such a way that the stiffening brace becomes unnecessary. This is presented in conjunction with FIGS. 3*a*–3*c*.

Thus, FIGS. 3*a*–3*c* present another, simpler alternative for additional pressing. The embodiments detailed above are simplified so that flexible guard 7 functions by itself as a suitably equipped or formed additional compactor. In the presented embodiment, flexible guard 7 has a fold or bevel 7.1, from which it follows that the guard's lower edge presses the edge of the block tightly against the base, thus achieving at least almost the same result as is achieved by the additional compactor described above. The use of a suitably rigid material to make the guard will assist in this. It is evident that the location of the bevel must be selected in the appropriate way. There can also be more than one bevel. Other alternative ways of bringing about tension in guard 7 may also be used. The essential thing is that the bevelling or corresponding measure creates tension in the flexible support, by means of which the book stays in place.

With the method according to the invention, crookedness in book spines has been almost eliminated. Previously, the pages would buckle under the influence of the cover's upward force throughout the unsupported distance up to the pressing shaft. Now, as the movable jaw moves towards its closed position shown in FIG. 2*b* or 3*b*, spring 9.3, in the case of FIGS. 2*a*–2*c*, is compressed and shaft 9.2 pushes stiffening brace 10 in front of it. The spring remains compressed until the movable jaw reaches its closed position portrayed in FIG. 2*c*. In the case of FIG. 3, the additional pressing is executed by the flexible guard without any separate devices.

In the cases detailed above, the part of the page block left unsupported is significantly less than before. Thus the pages will not buckle so much, nor will the cover lift off the base as easily as earlier. The spine of the book will be straighter once the adhesive joint has formed.

The additional pressing system may also, if so desired, be implemented so that compactors 9 function while attached to compression plate 6 and/or pressing shaft 5 in a way that swivelling of the compression plate will accomplish pressing without any special measures. Alternatively, the attachment may be such that pressing must be initiated and stopped as required.

Other adaptations of the invention not presented above are also possible while still remaining within the scope of the protection defined by the inventive idea and the accompanying claims. For example, other objects than books that require binding may also come into question. At the same time, the invention functions well in all adhesive binding devices regardless of whether the graining/agglutination of the book is done at the top of the page, the bottom of the page or even the side edges.

The invention claimed is:

1. A method for additional pressing during a page nipping event in the adhesive binding of books or corresponding objects having a unitary cover including a first part, a spine and a second part, and a block of pages, comprising:

(a) folding the first part and spine around the block, then:

(b) separating the cover from the block after the cover is folded onto the block;

(c) applying glue to the spine for contact with a side surface of the block, and after which;

(d) folding the second part into shape by pressing an edge of the spine between the second part and the spine, and separately pressing the second part.

2. A method according to claim 1, characterized in that a compactor is attached to a stiffening brace which presses the second part of the cover.

3. A method according to claim 2, characterized in that the compactor is supported on a movable jaw.

4. A method according to claim 2, characterized in that the pressing of the second part is applied by a spring on the compactor.

5. A method according to claim 2, characterized in that the stiffening brace is attached to a flexible guard which contacts the second part of the cover.

6. A method according to claim 2, characterized in that the stiffening brace is attached to a shaft-of the compactor.

7. A method according to claim 1, further comprising the steps:

after step (a), of turning the spine to a predetermined position whereby the block releases from the spine to expose the spine for the subsequent gluing step; and after step (b) of turning the spine back to its prior position.

* * * * *